US009068252B2

(12) United States Patent
Wang et al.

(10) Patent No.: US 9,068,252 B2
(45) Date of Patent: Jun. 30, 2015

(54) METHODS FOR STRENGTHENING SLOWLY-QUENCHED/COOLED CAST ALUMINUM COMPONENTS

(75) Inventors: Qigui Wang, Rochester Hills, MI (US); Dale A. Gerard, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 543 days.

(21) Appl. No.: 12/683,186

(22) Filed: Jan. 6, 2010

(65) Prior Publication Data

US 2010/0224293 A1 Sep. 9, 2010

Related U.S. Application Data

(63) Continuation-in-part of application No. 12/398,219, filed on Mar. 5, 2009.

(51) Int. Cl.

| | |
|---|---|
| ***C22F 1/04*** | (2006.01) |
| ***C22C 21/00*** | (2006.01) |
| ***C22C 21/02*** | (2006.01) |
| ***C22F 1/043*** | (2006.01) |
| ***C22F 1/047*** | (2006.01) |

(Continued)

(52) U.S. Cl.

CPC ..... *C22C 21/00* (2013.01); *C22C 21/02* (2013.01); *C22F 1/04* (2013.01); *C22F 1/043* (2013.01); *C22F 1/047* (2013.01); *C22F 1/053* (2013.01); *C22F 1/057* (2013.01)

(58) Field of Classification Search

CPC ..... C22F 1/04

USPC ..... 148/549, 698–702

See application file for complete search history.

(56) References Cited

U.S. PATENT DOCUMENTS

2009/0038720 A1 2/2009 Lumley et al.

FOREIGN PATENT DOCUMENTS

| | | | |
|---|---|---|---|
| CN | 1834281 | A | 9/2006 |
| CN | 101193839 | A | 6/2008 |

(Continued)

OTHER PUBLICATIONS

"Casting Design and Processes," Casting Design and Performance, ASM International, 2009, p. 9-36, ASM Handbook Committee for addition to the ASM Handbok series, 2010.*

(Continued)

*Primary Examiner* — Brian Walck

(74) *Attorney, Agent, or Firm* — Dinsmore & Shohl LLP

(57) ABSTRACT

Methods and technologies to maximize the aging response and the mechanical properties of aluminum alloys are provided. In one embodiment, the aging process for the slowly-quenched aluminum alloys includes, but is not limited to, at least a two-stage solution treatment and a two-stage aging hardening. In the solution treatment, the components are first heat treated at an initial solution treatment temperature and then gradually heated up to about 5° C. to about 30° C. above the initial solution treatment temperature for the material. For the aging treatment, the castings/components are first aged at a lower temperature followed by a higher temperature for the subsequent aging stages. The temperature increase during solution treatment and/or aging can be in steps, in a continuous manner, or combinations thereof. Another embodiment includes a two stage aging process in which there is a non-isothermal aging step.

20 Claims, 5 Drawing Sheets

(51) Int. Cl.
*C22F 1/053* (2006.01)
*C22F 1/057* (2006.01)

(56) References Cited

FOREIGN PATENT DOCUMENTS

| | | | |
|---|---|---|---|
| CN | 101525732 | A | 9/2009 |
| DE | 69725490 | T2 | 8/2004 |
| DE | 102006057660 | A1 | 6/2008 |
| WO | WO 2006066314 | A1 * | 6/2006 |

OTHER PUBLICATIONS

Shabel et al. "Aluminum—Silicon Alloy Applications," Friction and Wear of Aluminum—Silicon Alloys. Friction, Lubrication, and Wear Technology, vol. 18, ASM Handbook, ASM International, 1992, pp. 785-794.*

Lumley, R. N., et al., Blister Free Heat Treatment of High Pressure Die-Casting Alloys, Materials Science Forum, vols. 519-521 (2006), pp. 351-358.

Lumley, R. N., et al., The Development of Heat Treatment Procedures for Aluminum High Pressure Die-Castings, Proc. 13th Die Casting Conference of the Australian Die Casting Association, Melbourne, Australia (2006), 6 pgs.

Lumley, R. N., et al., Heat Treatment of High-Pressure Die Castings, Metallurgical and Materials Transactions A, vol. 38A, Oct. 2007, pp. 2564-2574.

Shercliff, H. R., et al., A Process Model for Age Hardening of Aluminium Alloys-I. The Model, Acta Metall. Mater. vol. 38, No. 10, 1990, Great Britain, pp. 1789-1802.

Lifshitz, I. M., et al. The Kinetics of Precipitation From Supersaturated Solid Solutions, J. Phys. Chem. Solids, Pergmon Press 1 961, vol. 19, Nos. 1/2, pp. 35-50, Great Britain.

Evancho, J.W., et al., Kinetics of Precipitation in Aluminum Alloys During Continuous Cooling, Metallurgical Transactions, vol. 5, Jan. 1974-43, Supplied by The British Library, pp. 1-5.

Wagner, Theory of the Aging of Precipitation by Umlosen, Bd. 65, Nr. 7/8, 1961, pp. 581-591.

* cited by examiner

METHODS FOR STRENGTHENING SLOWLY-QUENCHED/COOLED CAST ALUMINUM COMPONENTS

CROSS-REFERENCE TO RELATED APPLICATIONS

This application is a continuation-in-part of U.S. patent application Ser. No. 12/398,219 filed on Mar. 5, 2009, entitled METHODS OF ENHANCING MECHANICAL PROPERTIES OF ALUMINUM ALLOY HIGH PRESSURE DIE CASTINGS.

FIELD OF THE INVENTION

The present invention relates to methods and technologies that improve the tensile properties of aluminum alloys, and particularly heat treatable cast aluminum alloys slowly-cooled/quenched after solidification and/or solution treatment for minimizing residual stresses and distortion.

BACKGROUND TO THE INVENTION

Thermal quenching is important in the heat treatment processes of metal objects. For aging hardenable materials, like many cast aluminum alloys, the thermal quenching helps to develop a supersaturated solid solution for subsequent precipitation hardening. The higher supersaturation usually leads to better mechanical properties (especially yield strength) through subsequent aging/precipitation hardening processes. The extent of the supersaturation of strengthening elements in a solid solution after quenching is strongly dependent upon the quenching rate. Rapid quenching/cooling usually results in high solute supersaturation. As a result, the material is frequently quenched into cold or warm water to maximize solution supersaturation.

Many metal parts, such as engine blocks and cylinder heads, have complex shapes and different wall thicknesses. A significant amount of residual stresses and distortion can be developed in the metal parts even when they are quenched in warm or boiling water. When tight tolerance is required for manufacturing the parts, the resulting distortion can be costly and difficult to correct. Although service performance is an important factor for reducing residual stresses, another incentive is for a reduction in distortion during machining.

One approach to reducing the difference in the cooling rate between different sections of a part is the use of a milder quenching medium such as hot/boiling water, water-polymer or polymer solutions, or even forced air quench. Although air quenching is one of the most effective ways to reduce residual stresses and distortion, it can dramatically lower the mechanical properties of the final product. FIG. 1 shows an example of a significant reduction of residual stress in a cylinder head with an air quench v. a water quench. FIG. 2 shows an example of the reduction of tensile properties with an air quench.

Therefore, there is a need for a method to improve the mechanical properties of cast aluminum components slowly quenched/cooled after solution heat treatment and/or solidification.

SUMMARY OF THE INVENTION

The present invention meets this need. Methods and technologies to maximize the aging response and the mechanical properties of aluminum alloys are provided. These methods are applicable to all age-hardenable aluminum alloys including both wrought and cast aluminum alloys.

In one embodiment, the improved strengthening process for the slowly-quenched/cooled aluminum alloys includes, but is not limited to, at least a two-stage solution treatment and a two-stage aging hardening. In the solution treatment, the components are first heat treated at an initial solution treatment temperature for the alloy (about 5 to 10° C. below the solidus) and then gradually heated up to about 5° C. to about 30° C. above the initial solution treatment temperature for the material. The temperature increase during solution treatment can be in steps, in a continuous manner, or combinations thereof. The temperature change profile may be determined and optimized based on thermodynamics and kinetics. For the aging treatment, the castings/components are first aged at a lower temperature compared to the subsequent aging step(s), typically between about room temperature and about 100° C. The preferred pre-aging temperature is between about 65° C. and about 95° C. The pre-aging time varies with the pre-aging temperature, and it can be as long as several days or weeks when the parts are initially naturally aged at room temperature. The subsequent aging steps are generally performed at temperatures over about 100° C., for example, between about 140° C. and about 240° C., with a preferred temperature between about 165° C. and about 200° C. The temperature change during the subsequent aging process can be in steps, in a continuous manner, or combinations thereof. The temperature change profile may be determined and optimized based on thermodynamics and kinetics. The subsequent aging time in each step varies from about 1 to about 10 hours, with a preferred total subsequent aging time between about 4 to about 8 hours.

In another embodiment, a method of improving a mechanical property of a heat treatable aluminum alloy is provided. The method includes at least a two stage aging process. There is a pre-aging stage in which the aluminum alloy is pre-aged at a temperature in a range of about room temperature to about 100° C., and a non-isothermal aging stage at an aging temperature above the pre-aging temperature.

DETAILED DESCRIPTION OF THE INVENTION

Aging produces precipitation hardening by heating the component to a temperature and then holding the casting at the temperature for a period of time. Because precipitation hardening is a kinetic process, the solute content in the as-quenched aluminum matrix (solution) plays an important role in the aging responses. Mg, Cu, and Si are typical hardening solutes employed in aluminum alloys. Mg combines with Si to form Mg/Si precipitates such as β", β' and equilibrium $Mg_2Si$ phases. The actual precipitate type, amount, and sizes depend on the aging conditions. Underaging tends to form shearable β" precipitates, while in peak and over aging conditions, unshearable β' and equilibrium $Mg_2Si$ phases form. In aluminum alloys, Si alone can form Si precipitates, but the strengthening is not as effective as with Mg/Si precipitates. Cu can combine with Al to form many metastable precipitate phases, such as θ', θ in Al—Si—Mg—Cu alloys. Similar to Mg/Si precipitates, the actual precipitate type, size, and amount depend on aging conditions and alloy compositions.

To obtain the full advantages of this invention, the aluminum alloys should contain aging hardening elements (solutes), particularly including Mg, Cu, Si, and Zn. Desirably, the content of the aging hardening solutes should meet certain minimum amounts. The Mg content in the aluminum alloys is desirably more than about 0.2 wt %, and the preferred level is about 0.3 wt % or above. The copper content is desirably more than about 0.5 wt %, and the preferred level is about 0.8 wt % or above. The Si content in the aluminum alloys is desirably more than about 0.5 wt %. For cast aluminum alloys, the preferred Si content is desirably about 5% or above. Zn is a very important element that combines with Mg forming $MgZn_2$ precipitates at relatively low temperature (about 75 to about 100° C.). The Zn content is desirably more than about 0.3 wt %, and the preferred level is about 0.5 wt % or above.

Figure 1:
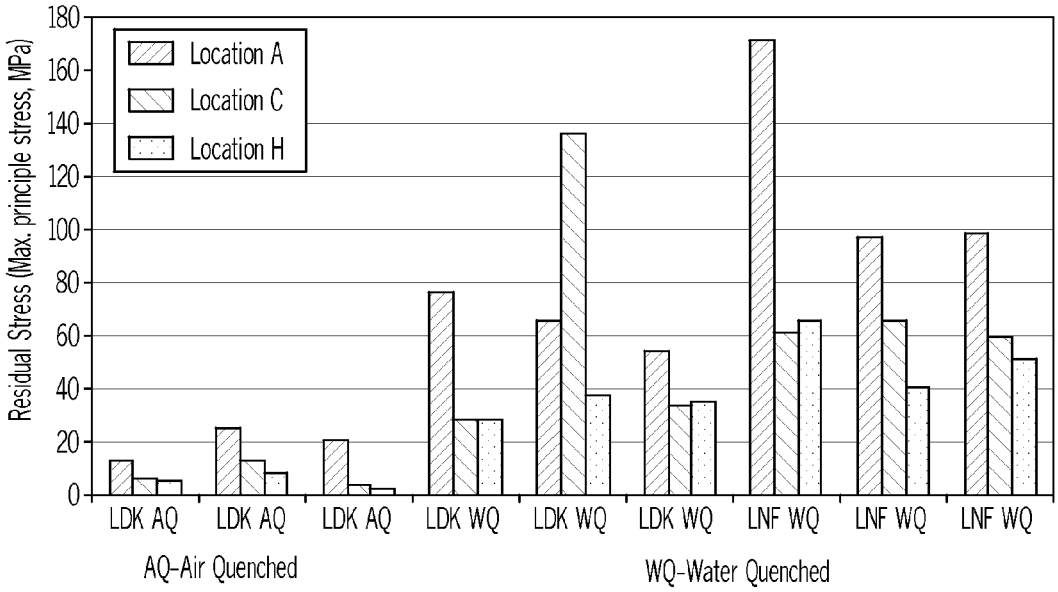
FIG. 1 is a comparison of the residual stress distribution in a cylinder head.
Figure 2:
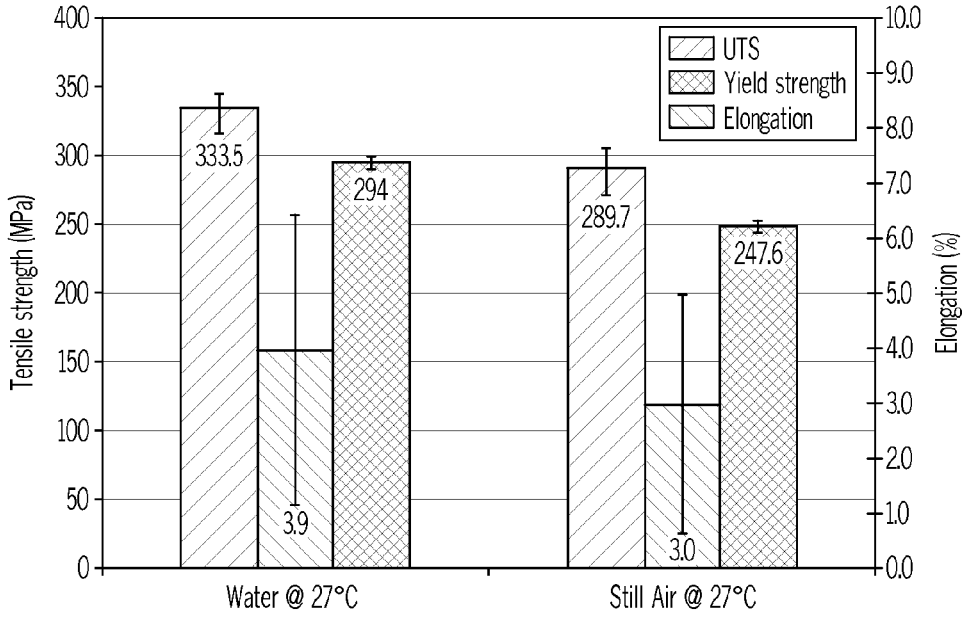
FIG. 2 is a comparison of tensile properties of a cast aluminum alloy quenched in water and air.
Figure 3:
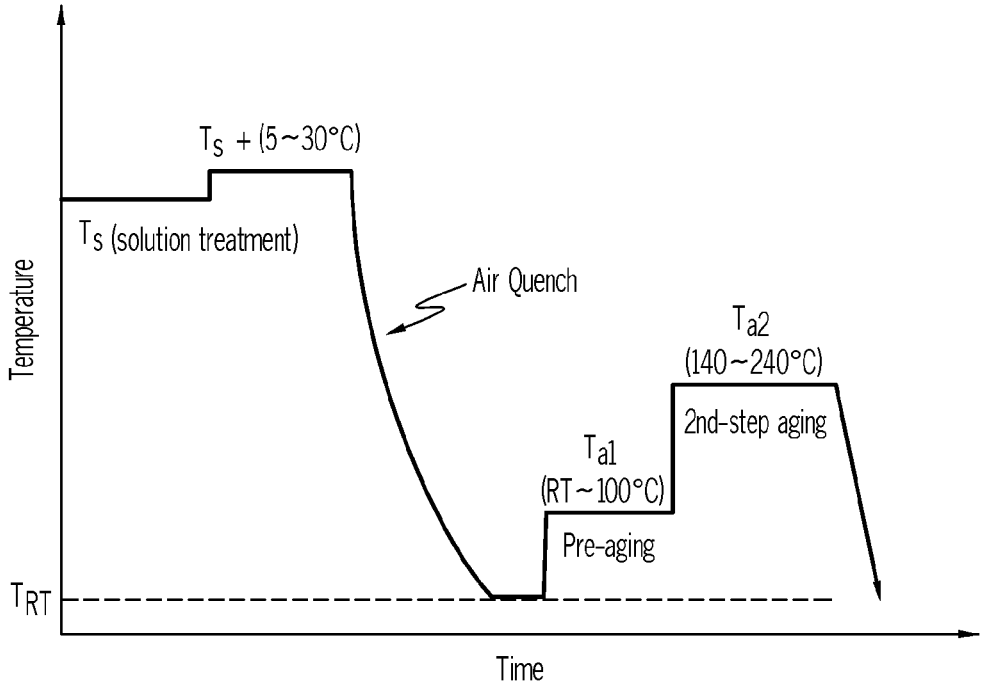
FIG. 3 is a schematic of one embodiment of a multistep solution and aging process for slowly-quenched cast aluminum components.

FIG. 3 illustrates one embodiment of a multistep solution and aging process. With the techniques developed, the tensile strengths of the slowly-quenched cast aluminum components can be increased by at least about 10%.

Figure 4:
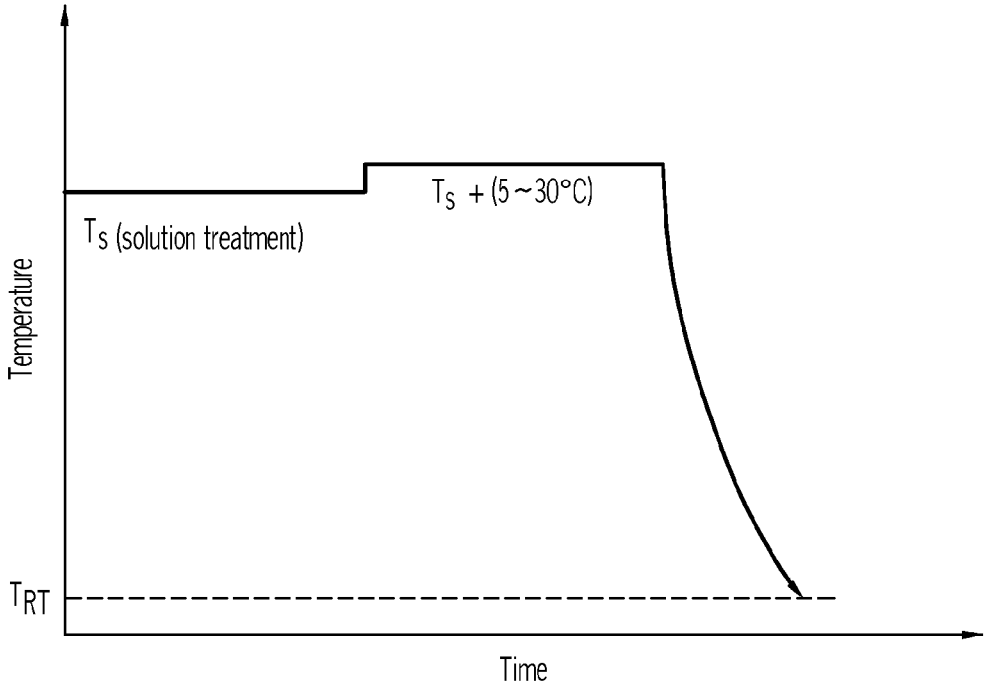
FIG. 4 is a schematic illustration of one embodiment of a multistep solution treatment.

To maximize the solute dissolution during solution treatment, the components are heat-treated in two or more stages. The components are first treated at an initial solution temperature, for example, about 540° C. for A356 alloy and about 490° C. for 319 alloy, for about half of the period of the specific solution treatment time. Afterwards, the components are heated to about 5° C. to about 30° C. above the initial solution temperature and held at that temperature for the other half of the specific solution treatment time. A higher temperature is preferred in the second step, provided that no incipient melting is produced. FIG. 4 schematically shows an example of the proposed multistep solution treatment.

The solution treatment temperature varies with the alloy, and is related to the solidus of the alloy. The solidus of the alloy can be accurately calculated based on thermodynamics, or it can be determined experimentally. In general, the solution treatment temperature should be lower than the solidus to avoid any incipient melting. Textbooks and handbooks provide solution temperatures for many commercial alloys. In many cases, the temperatures reported in the handbook or textbook were determined experimentally.

Figure 5:
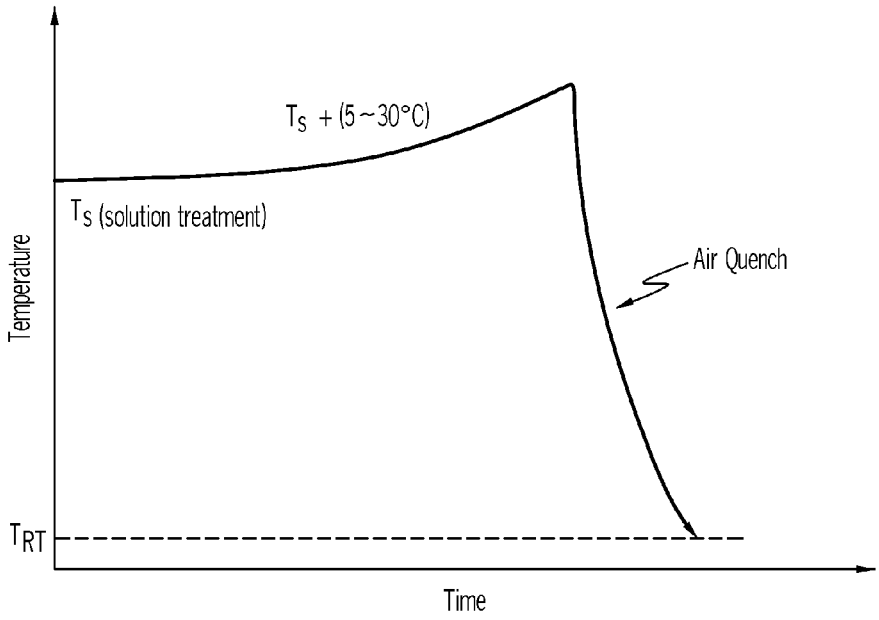
FIG. 5 is a schematic illustration of another embodiment of a multistep solution treatment.

The temperature change during the solution treatment does not have to be a step increase. The temperature can be gradually increased based on the alloy melting point change due to the continuous dissolution of low-melting intermetallic phases. In aluminum alloys, solution heat treatment involves dissolution of intermetallics, reduction of microsegregation, and fragmentation and spherodization of second phase particles. With the proceeding of solution treatment, low melting-point equilibrium phases in the materials are dissolved gradually, depending upon the diffusion kinetics. As a result, the melting point of the remaining materials becomes high, and the alloy can be gradually heated to a higher temperature, as shown in FIG. 5.

The maximum feasible solution treatment temperature at a given time depends on the state of microstructure evolution and the existence of the phases of the materials. The upper limit of the solution treatment temperature, $T_{sol}$, should not exceed the lowest melting point of the remaining phases.

$$T_{sol} < \underset{(T,t,C\in\Omega)}{\mathrm{Min}} T_{m(T,t,C)} \quad (1)$$

$$\Omega = \{0 < T_{sol} < T_c;\ 0 < t < \infty;\ 0 < C < C_0\}$$

The temperature can be increased to a point above which incipient melting would take place. The non-isothermal solution treatment temperature profile can be calculated based on computational thermodynamics and kinetics, as well as the initial alloy and as-cast microstructure. This non-isothermal temperature profile during solution treatment can be realized in either batch or continuous furnaces. For the continuous furnace, variable temperatures can be set up at different zones in the furnace.

Figure 6:
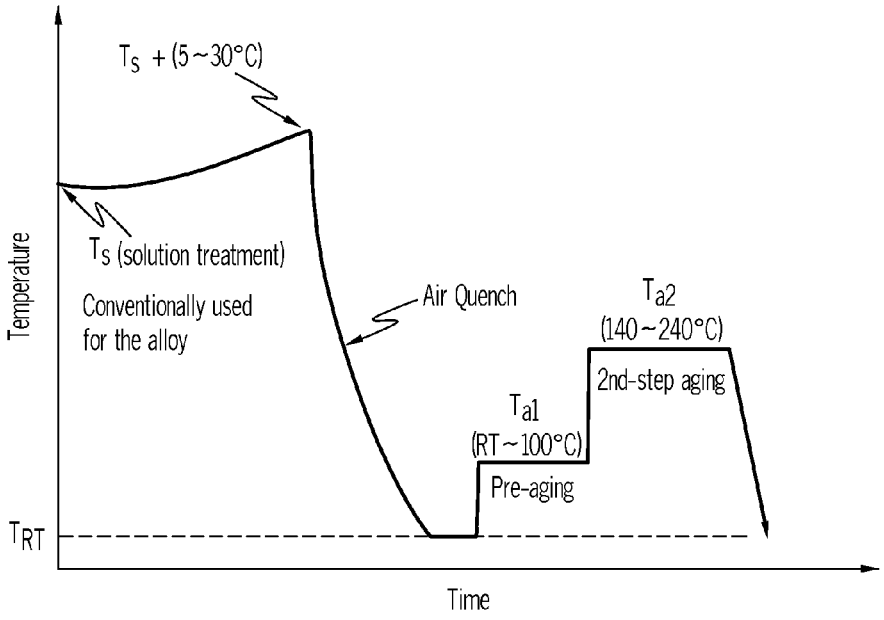
FIG. 6 is a schematic of another embodiment of a non-isothermal solution and step aging process for slowly-quenched cast aluminum components.

One embodiment of a solution treatment and air quench utilizing this approach is shown in FIG. 6.

In cast aluminum alloys, the dissolution of the equilibrium second phase during solution heat treatment can be considered as a diffusion-controlled process. For the dissolution of a spherical precipitate (particle) with a curvature of p, the rate of dissolution can be estimated by:

$$\frac{dr_i}{dt} = -\left(\frac{(C_i^d - C_i^g)D_i}{(C_i^p - C_i^d)r_i}\right) - \left(\frac{C_i^d - C_i^g}{C_i^p - C_i^d}\right)\left(\frac{D_i}{pt}\right)^{1/2} \quad (2)$$

where $r_i$ is the radius of the $i^{th}$ precipitate, $C_i^d$ is the equilibrium concentration of solute at the dissolution temperature, $C_i^g$ is the equilibrium concentration of solute at the growth temperature, $C_i^p$ is the concentration of solute in the $i^{th}$ precipitate, $D_i$ is the diffusivity, p is the curvature of the precipitate, and t is the time of dissolution.

Eq. (2) requires knowledge of the solute concentration profile, which can use the following equation for multicomponent diffusion, namely $$\frac{\partial C_i(r,t)}{\partial T} = \nabla \cdot \Sigma Dij \nabla Cj(r,t) \quad (3)$$

where $C_i(r, t)$ is the concentration of the $i^{th}$ element at position r and time t, $C_j(r, t)$ is the concentration of the $j^{th}$ element at position r and time t, while $D_{ij}$ represents the diffusion coefficients of the solutes such as Mg, Cu in aluminum matrix. Eqs. (2) and (3) can be solved through iteration. Coarsening of second phase particles, such as Si, occurs either through Ostwald ripening or coalescence or through a combination of both mechanisms. Ostwald ripening involves mass transfer by the detachment of atoms from smaller structures, followed by diffusion of these atoms through the matrix to attach themselves to the surface of larger structures. The end result of ripening is shrinkage of the smaller structures and growth of the larger structures. The average particle size in the system increases while the number density of particles decreases. Coalescence, on the other hand, involves the merging of two or more particles. For this to occur the particles must be in contact with each other; and in this case, the driving force is the decrease in surface energy. The most frequently referenced description of coarsening is that due to Liftshitz-Sylozov-Wagner (LSW), namely $$r_{eq}^3 - r_o^3 = \frac{8}{9}\frac{DC_o\gamma V_{atom}^2 t}{RT} \tag{4}$$

where $r_{eq}$ is the radius of the coarsening precipitate and $r_o$ is its initial radius, D is the diffusivity, R is the universal gas constant, $C_o$ is the equilibrium concentration of the coarsening phase, T is temperature, γ is the surface energy, $V_{atom}$ is the atomic volume ($m^3$/mol), and t is the time of coarsening. (I. M. Lifshitz and V. V. Slyozov, *Phys. Chem. Solids*, vol. 19 (1961), 35; C. Wagner, *Z. Electrochem., vol.* 65 (1961), 581.)

The amount of solute elements decreased during slow cooling/quenching after solution treatment and/or solidification, due to formation of precipitates, can be estimated using Quench Factor Analysis (QFA) approach. (W. Evancho, J. T. Staley: Metallurgical Transactions, v. 5, p. 43-47, 1974.) The assumptions behind quench factor analysis include that the precipitation reaction during quenching is additive and the reduction in strength (after aging) can be related to the reduction of supersaturation of the solid solution during quenching.

The amount of precipitates formed during slow quenching/cooling after solution treatment and/or solidification can be estimated by a unitless microstructural state variable, S.

$$\frac{dS}{dt} = \frac{S_{eq} - S}{t_c} \tag{5}$$

where $S_{eq}$ is the maximum amount of precipitates formed in an equilibrium condition (for an arbitrarily long isothermal holding) at a temperature during cooling. The value of $S_{eq}$ can be calculated by:

$$S_{eq} = 1 - \exp\left[\frac{\Delta H}{R}\left(\frac{1}{K_4} - \frac{1}{T}\right)\right];\ T \le K_4 \tag{6}$$

where $K_4$ is the solvus temperature and ΔH is the precipitation enthalpy for a quench precipitate.

In Eq. (5), t, is the critical time when the precipitates start to nucleate and grow, is given by:

$$t_c = K_2\exp\left[\frac{K_3K_4^2}{RT(K_4 - T)^2} + \frac{K_5}{RT}\right] \tag{7}$$

where $K_2$ is a constant related to the reciprocal of the number of nucleation sites; $K_3$ is a constant related to the energy required for heterogeneous nucleation (J/mol); $K_4$ is a constant related to the solvus temperature; $K_5$ is a constant related to the activation energy for diffusion (J/mol); R is the universal gas constant, 8.3143 J/(K mol); and T is absolute temperature (K).

The numerical algorithm to determine the increment of i precipitate at a given time step j during quench is given by:

$$\Delta S_{ij} = (S_{eq} - S_{i,j-1})\left[1 - \exp\left(\frac{-\Delta t_{ij}}{t_{cij}}\right)\right] \tag{8}$$

At the end of the quench, the total amount of $i^{th}$ precipitates $S_i$ is:

$$S_i = \Sigma_j \Delta S_{ij} \tag{9}$$

For each quench precipitate, the coefficients can be calibrated with experimental data of mechanical properties and temperature profiles during quenching. Table 1 shows the coefficients fitted for aluminium alloy A357. Table 2 shows the coefficients fitted for aluminium alloy A356+1% Cu. $K_4$, $K_5$ and ΔH were calculated from thermodynamics. Note that $K_3$ for Si is 0, making the curve effectively pure growth.

TABLE 1

Coefficients for the A357 quench model.

| | $K_2$ (s) | $K_3$ (J/mol) | $K_4$ (°K) | $K_5$ (J/mol) | k (MPa) | ΔH (J/mol) | $\sigma_{YSmax}$ (MPa) |
|---|---|---|---|---|---|---|---|
| Si Particle Growth | $5.28 \times 10^{-6}$ | 0 | 813 | 125,200 | 37.4 | 60,000 | 301 |
| β on Si Particles | $6.80 \times 10^{-9}$ | 354 | 813 | 119,812 | 92.5 | 53,066 | |
| β in the Matrix | $6.24 \times 10^{-11}$ | 1439 | 813 | 119,812 | 126.1 | 53,066 | |

TABLE 2

Coefficients for the A356 + 1% Cu quench model.

| | $K_2$ (s) | $K_3$ (J/mol) | $K_4$ (°K) | $K_5$ (J/mol) | k (MPa) | ΔH (J/mol) | $\sigma_{YSmax}$ (MPa) |
|---|---|---|---|---|---|---|---|
| Si Particle Growth | $5.28 \times 10^{-6}$ | 0 | 813 | 125,200 | 37.4 | 60,000 | 294 |
| β in the Matrix | $6.24 \times 10^{-11}$ | 1439 | 764 | 119,812 | 126.1 | 53,066 | |
| θ in the matrix | | | 723 | | | 212,200 | |

Figure 7:
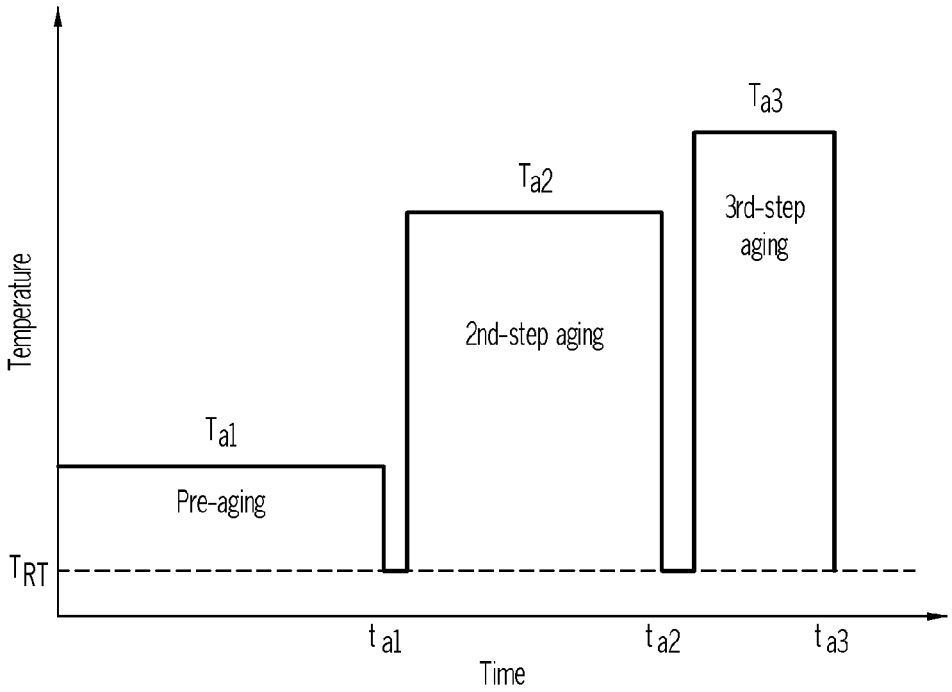
FIG. 7 is a schematic illustration of one embodiment of a multistep aging scheme.

The age hardening process of aluminum alloys includes formation of GP zones, and coherent and incoherent precipitates, which is in correspondence to nucleation, growth and coarsening of precipitates. To maximize the number density of vacancies, and in particular to initiate a great number of GP zones in the as-quenched cast aluminum alloy components/parts, it was discovered to pre-age the materials at a lower temperature, followed by one or more aging stages at higher temperatures. FIG. 7 schematically shows one embodiment of a three-stage aging scheme. The aging temperature and aging time for each stage depend upon the alloy compositions and productivity requirements. It should be noted that the heat treated components are not necessarily cooled to room temperature between aging stages, although they can be if desired.

Figure 8:
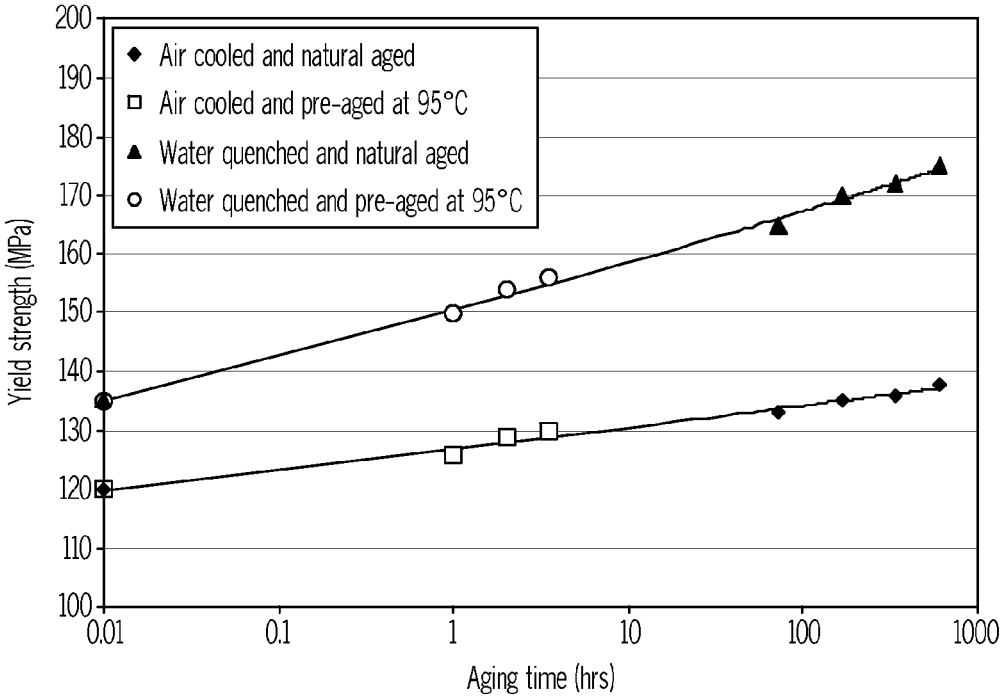
FIG. 8 is a comparison of the pre-aging responses of a HPDC alloy (A380) in both water quench and air cool conditions.

The pre-aging step is designed to generate more GP zones and fine precipitate nuclei. The variation of the precipitate density (number of precipitates by unit volume) is directly related to the nucleation rate which is dependent upon the aging temperature and time. For aluminum alloys, such as A356, A319 and A380 and their variants, the pre-aging temperature will generally vary from room temperature to about 100° C., although it could be higher or lower if desired. Because the nucleation and formation of GP zones and/or fine precipitates are kinetic processes, a longer aging time is expected for a lower aging temperature. If the parts are naturally aged at room-temperature, for instance, the aging time can be as long as several days or even several weeks. FIG. 8 compares the aging responses of tensile specimens (12.85 mm in diameter) of A380 alloy cast in permanent mold and pre-aged at room temperature and 95° C.

Subsequent aging after pre-aging is designed to maximize the tensile strength of the slowly-quenched aluminum components. The subsequent aging may include, but is not limited to, one or more isothermal aging steps. The aging temperatures in the subsequent aging steps are generally kept above about 100° C., and are typically between about 140° C. and about 240° C. for most aluminum alloys and their variants. The preferred aging temperature range is between about 165° C. and about 200° C. If high productivity and short aging time is desired, a higher aging temperature, for instance about 200° C., can be utilized. Otherwise, a slightly lower aging temperature, for instance about 180° C., is recommended for higher tensile strengths. For a HPDC alloy (A380), one of the optimal aging schemes is pre-aging at about 95° C. for about 2.5 hrs followed by two step aging at about 180° C. for about 4 hrs and about 200° C. for about 1 hr.

Figure 9:
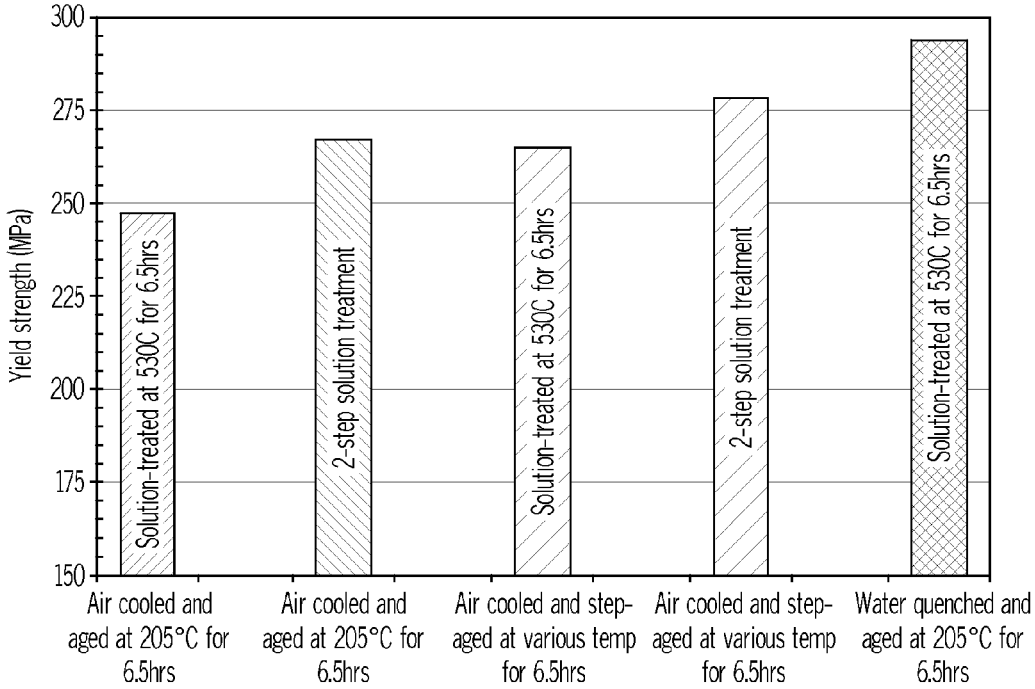
FIG. 9 is a graph illustrating the yield strength improvement of air-quenched A356+1% Cu alloy using different embodiments of the multistep solution and aging process.

FIG. 9 shows experimental results of a multistep solution and aging process for A356+1% Cu alloy. For the same solution treatment condition (either single stage or two and more stage solution treatment), the multistage aging can increase the yield strength by 5 to 10%. It should be noted that the Zn content in the A356 is less than 0.1 wt %. If the alloy had higher Zn level (for example, >0.5 wt %), the tensile properties could be further improved, particularly when the materials are slowly quenched/cooled after solution treatment and/or solidification. For the same aging cycle, a multistage solution treatment can further improve the tensile properties by 5 to 10%.

Figure 10:
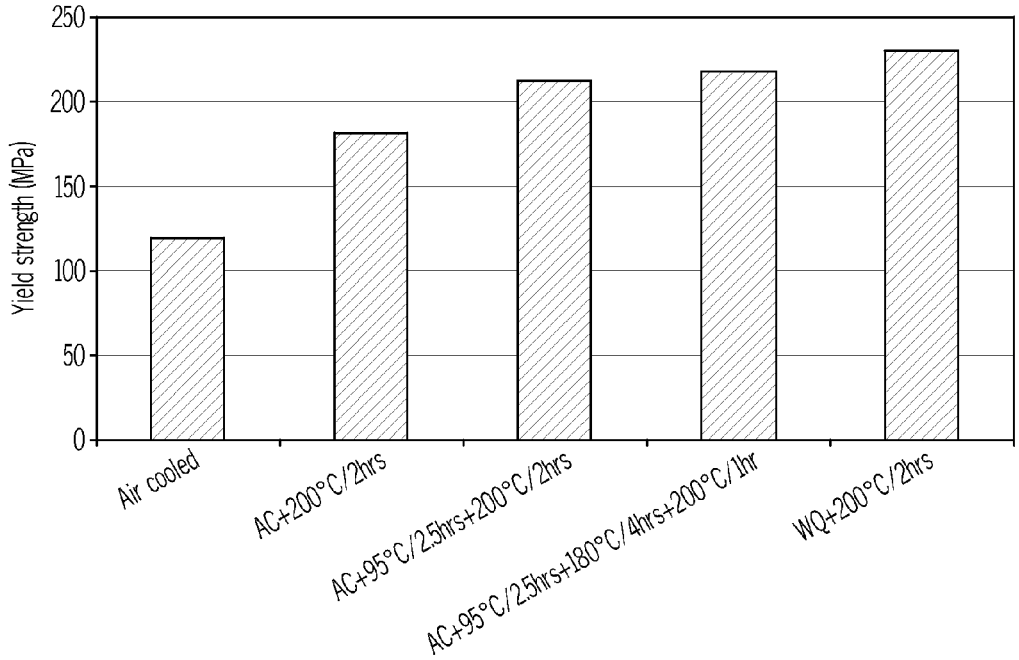
FIG. 10 is a graph illustrating the yield strength improvement of an as-cast and air-quenched A380 alloy using different embodiments of the multistep aging process.

FIG. 10 shows experimental results of multistage aging cycles applied to an as-cast and air-cooled A380 (0.35 wt % Mg) alloy. As expected, the yield strength can be improved steadily by implementing the techniques in this invention one by one. The multistage solution treatment and aging process can increase the yield strength by at least 10%.

The tensile properties of slowly-quenched aluminum alloys can be as good as fast-quenched alloys while the residual stresses and distortion are much lower. The tensile strengths of the slowly-quenched alloys can be increased by at least 10% compared to alloys using a conventional aging process.

The improved tensile properties of the slowly-quenched aluminum alloys (with minimal residual stress) increase their durability and thus extend their acceptance and use in critical structural applications such as engine blocks, cylinder heads, transmission cases, and suspension components. A significant reduction in warranty cost of cast aluminum components in automotive applications could also result.

The temperature change during subsequent aging process can be in steps, in a continuous manner, or combinations thereof. The temperature change profile may be determined and optimized based on computational thermodynamics and kinetics.

The yield stress of an aging hardenable aluminum alloy after aging can be estimated as $$\sigma_{ys}=\sigma_{ys\text{-}Al}+\sigma_{disp}+\sigma_{q\text{-}ppt}+\sigma_{a\text{-}ppt}+\sigma_{ss} \tag{10}$$

where $\sigma_{ys\text{-}Al}$ is the yield stress of pure aluminum (about 15 MPa), $\sigma_{disp}$ is the yield strength increase due to dispersive second phase (eutectic) particles, $\sigma_{q\text{-}ppt}$ is the yield strength change due to precipitates formed during quenching, $\sigma_{a\text{-}ppt}$ is the yield strength increase after quenching due to aging hardening from precipitates, $\sigma_{ss}$ is the yield strength increase by solid solution after aging. In commercial cast aluminum alloys (such as A356, 319, A380, etc), the yield strength increase from eutectic particles can be calculated by;

$$\sigma_{disp}=C_0\alpha\mu_{Al}f\epsilon \tag{11}$$

where $\epsilon$ is the plastic strain, $\alpha$ is the average aspect ratio of eutectic particles, $\mu_{Al}$ is the shear modulus of aluminum matrix, f is the volume fraction of second phase (eutectic) particles, and $C_0$ is the constant. At 0.2% plastic strain (which is the strain defined for determining yield strength of the material), the yield strength increase due to eutectic particles is between 10 to 20 MPa (depending on the volume fraction of the second phase particles in the material) for many cast aluminum alloys.

The contribution to yield strength by precipitates during aging, $\sigma_{a\text{-}ppt}$, is a combination of shearable and by-passing precipitates. The strengthening by shearable precipitates ($\sigma_{ppt_s}$) is approximately related to the precipitate volume fraction ($f_{ppt}$) and the precipitate radius ($r_{ppt}$) by a constant $C_1$:

$$\sigma_{ppt_s}=C_1\sqrt{f_{ppt}r_{ppt}} \tag{12}$$

Similarly, the contribution to yield strength due to by-passing of dislocations around non-shearable precipitates ($\sigma_{ppt_b}$) is approximately related to the precipitate volume fraction ($f_{ppt}$) and the precipitate radius ($r_{ppt}$) by a constant $C_2$:

$$\sigma_{ppt_b}=C_2\frac{\sqrt{f_{ppt}}}{r_{ppt}} \tag{13}$$

Eqs. (12) and (13) may be combined to describe the increase in yield strength up to a peak with increasing aging time (while the precipitates are shearable), and the decrease in yield strength with overaging when the precipitates become larger, non-shearable and less coherent. The single-peak aging curves can be described by taking the harmonic mean of Eqs. (12) and (13) (H. R. Shercliff, M. F. Ashby, Acta Metall. Mater. 38 (1990) 1789):

$$\sigma_{a-ppt} = \frac{2\sigma(t, T)P*^{1/6}}{1 + P*^{1/2}} \tag{14}$$

where σ(t,T) is the precipitate strength and $P^*=P/P_p$. The term P is the temperature-corrected time:

$$P = \frac{t}{T}\exp\left(\frac{-Q_A}{RT}\right) \tag{15}$$

where t is the aging time, T, the ageing temperature, $Q_A$, the activation energy for volume diffusion of atoms through the matrix and R, the gas constant. The parameter $P_p$ is the value of P at the peak in the aging curve. Thus $Q_A$ can be determined from the slope of a plot of $\ln(t_p/T)$ vs 1/T, where $t_p$ is the aging time at $P_p$.

The precipitate strength, σ(t,T), can be expressed as a function of ageing time (t) and temperature (T):

$$\sigma(t, T) = (\sigma_0)_{max}\left[1 - \exp\left(\frac{-Q_s}{R}\left(\frac{1}{T} - \frac{1}{T_s}\right)\right)\right]^{1/2}\left[1 - \exp\left(\frac{-t}{\tau_1}\right)\right]^{1/2} \tag{16}$$

where the strengthening parameter $(\sigma_0)_{max}$, the solvus enthalpy ($Q_s$) and the metastable solvus temperature ($T_s$) are determined from experimental aging data or thermodynamic calculations. The constant ($\tau_1$) is related to the aging time corresponding to the peak ($t_p$) by the constant $K_1$:

$$\tau_1 = K_1 t_p \tag{17}$$

The solid solution hardening contribution after aging ($\sigma_{ss}$) in Eq. (10) varies with aging time at a given temperature, and can be described by:

$$\sigma_{ss} = \left[\sigma_{ssf}^{3/2} + [\sigma_{ssi}^{3/2} - \sigma_{ssf}^{3/2}]\exp\left(\frac{-t}{\tau_1}\right)\right]^{2/3} \tag{18}$$

where the subscripts refer to initial ($\sigma_{ssi}$) and final ($\sigma_{ssf}$) solid solution strengthening contributions. The initial solid solution strengthening contribution can be determined from the difference between the as-quenched yield strength ($\sigma_{aq}$) and the intrinsic yield strength ($\sigma_{ys\text{-}Al}+\sigma_{disp}+\sigma_{q\text{-}ppt}$):

$$\sigma_{ssi} = \sigma_{aq} - \sigma_{ys\text{-}Al} - \sigma_{disp} - \sigma_{q\text{-}ppt} \tag{19}$$

whereas the final solid solution strengthening contribution is the difference between the overaged yield strength ($\sigma_{oa}$) at that aging temperature and the intrinsic yield strength ($\sigma_{ys\text{-}Al}+\sigma_{disp}+\sigma_{q\text{-}ppt}$).

$$\sigma_{ssf} = \sigma_{oa} - \sigma_{ys\text{-}Al} - \sigma_{disp} - \sigma_{q\text{-}ppt} \tag{20}$$

The overaged yield strength ($\sigma_{oa}$) may be determined from known values of the as-quenched yield strength ($\sigma_{aq}$) and the intrinsic yield strength ($\sigma_{ys\text{-}Al}+\sigma_{disp}+\sigma_{g\text{-}ppt}$):

$$\sigma_{oa} = \sigma_{ys-Al} + \sigma_{disp} + \sigma_{q-ppt} + (\sigma_{aq} - \sigma_{ys-Al} - \sigma_{disp} - \sigma_{q-ppt})\exp\left[\frac{-2Q_s}{3R}\left(\frac{1}{T} - \frac{1}{T_s}\right)\right] \tag{21}$$

The yield strength change due to precipitation during slow quenching can be estimated by:

$$\sigma_{q\text{-}ppt} = \sigma_i k_i S_i^{1/2} \tag{22}$$

The $S_i$ and $k_i$ are taken from Eq (9) and Tables 1 and 2.

The solvus enthalpy ($Q_s$) is determined for each aging temperature using:

$$Q_s = \left[-R\Big/\left(\frac{1}{T} - \frac{1}{T_s}\right)\right]\left[\ln\left(1 - \frac{\sigma_0^2}{(\sigma_0)_{max}}\right)\right] \tag{23}$$

The precipitate strength $\sigma_0$ depends on the aging temperature because the volume fraction of precipitates varies with temperature. The $\sigma_0$ can be calculated by:

$$\sigma_0(T) = (\sigma_0)_{max}\left[1 - \exp\left[\frac{-Q_s}{R}\left(\frac{1}{T} - \frac{1}{T_s}\right)\right]\right]^{1/2} \tag{24}$$

It is noted that terms like "generally," "commonly," and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the terms "substantially," "significantly, " and "approximately" are utilized herein to represent the inherent degree of uncertainty that may be attributed to any quantitative comparison, value, measurement, or other representation. The terms "substantially," "significantly," and "approximately" are also utilized herein to represent the degree by which a quantitative representation may vary from a stated reference without resulting in a change in the basic function of the subject matter at issue.

Having described embodiments of the present invention in detail, and by reference to specific embodiments thereof, it will be apparent that modifications and variations are possible without departing from the scope of the embodiments defined in the appended claims. More specifically, although some aspects of embodiments of the present invention are identified herein as preferred or particularly advantageous, it is contemplated that the embodiments of the present invention are not necessarily limited to these preferred aspects.

What is claimed is:

1. A method of increasing the durability of at least one of a cylinder head and an engine block by improving a mechanical property of a permanent mold heat treatable aluminum alloy comprising:

providing the heat treatable aluminum alloy in molten form to a cast in permanent mold defined in a shape of the at least one of the cylinder head and the engine block wherein the alloy is not subjected to high pressure die casting;

heat treating the aluminum alloy at a solution treatment temperature for a first period of time;

heating the heat treated aluminum alloy to a temperature about 5° C. to about 30° C. above the solution treatment temperature;

cooling the heated aluminum alloy in air;

pre-aging the cooled aluminum alloy at a temperature in a range of about room temperature to about 100° C.; and performing subsequent steps of aging after preaging to improve tensile strength of the at least one of the cylinder head and the engine block by aging the pre-aged aluminum alloy by two-step aging at an aging temperature above the pre-aging temperature and then at a second aging temperature higher than the aging temperature, wherein the pre-aging and the aging steps are each at least an hour; and wherein the temperature changes following pre-aging are either in steps, in a continuous manner, or a combination thereof.

2. The method of claim 1 wherein the aluminum alloy is held at the temperature about 5° C. to about 30° C. above the solution treatment temperature for a second period of time and wherein the second period of time is about the same as the first period of time.

3. The method of claim 1 wherein heating the aluminum alloy to the temperature about 5° C. to about 30° C. above the solution treatment temperature is a non-isothermal heating.

4. The method of claim 1 wherein aging the pre-aged aluminum alloy is a non-isothermal aging.

5. The method of claim 1 wherein the pre-aging temperature is in the range of about 65° C. to about 95° C.

6. The method of claim 1 wherein the pre-aging temperature is at about 95° C. for about 2.5 hours followed by the two-step aging at about 180° C. for about 4 hours and about 200° C. for about 1 hour.

7. The method of claim 1 wherein the aging temperature is in a range of about 140° C. to about 240° C.

8. The method of claim 1 wherein the aluminum alloy contains at least one of Mg, Cu, Si, or Zn.

9. The method of claim 1 wherein the aluminum alloy contains at least one of more than about 0.2 wt % Mg, more than about 0.5 wt % Cu, more than about 0.5 wt % Si, or more than about 0.3 wt % Zn.

10. A method of increasing the durability of at least one of a cylinder head and an engine block by improving a mechanical property of a permanent mold heat treatable aluminum alloy cast in permanent mold comprising:

providing the heat treatable aluminum alloy in molten form to a cast in permanent mold defined in a shape of the at least one of the cylinder head and the engine block wherein the alloy is not subjected to high pressure die casting;

heat treating the aluminum alloy at a solution treatment temperature for the aluminum alloy for a first period of time;

heating the heat treated aluminum alloy to a temperature about 5° C. to about 30° C. above the solution treatment temperature;

cooling the heated aluminum alloy in air to room temperature;

pre-aging the cooled aluminum alloy at a temperature in a range of about room temperature to about 100° C.; and performing subsequent steps of aging after preaging to improve tensile strength of the at least one of the cylinder head and the engine block by aging the pre-aged aluminum alloy by two-step aging at an aging temperature in a range of about 140° C. to about 240° C. and then at a second aging temperature higher than the aging temperature, wherein the pre-aging and the aging steps are each at least an hour; and wherein the temperature changes following pre-aging are either in steps, in a continuous manner, or a combination thereof.

11. The method of claim 10 wherein the aluminum alloy is held at the temperature about 5° C. to about 30° C. above the solution treatment temperature for a second period of time and wherein the second period of time is about the same as the first period of time.

12. The method of claim 10 wherein heating the aluminum alloy to the temperature about 5° C. to about 30° C. above the solution treatment temperature is a non-isothermal heating.

13. The method of claim 10 wherein aging the pre-aged aluminum alloy is a non-isothermal aging.

14. The method of claim 10 wherein the pre-aging temperature is in the range of about 65° C. to about 95° C.

15. The method of claim 10 wherein the aging temperature is in the range of about 165° C. to about 200° C.

16. The method of claim 10 wherein the pre-aging temperature is at about 95° C. for about 2.5 hours followed by the two-step aging at about 180° C. for about 4 hours and about 200° C. for about 1 hour.

17. The method of claim 10 wherein the aluminum alloy contains at least one of more than about 0.2 wt % Mg, more than about 0.5 wt % Cu, more than about 0.5 wt % Si, and more than about 0.3 wt % Zn.

18. A method of increasing the durability of at least one of a cylinder head and an engine block by improving a mechanical property of a permanent mold heat treatable aluminum alloy cast in permanent mold comprising:

providing the heat treatable aluminum alloy in molten form to a cast in permanent mold defined in a shape of the at least one of the cylinder head and the engine block wherein the alloy is not subjected to high pressure die casting;

heat treating the aluminum alloy;

cooling the heated aluminum alloy in air;

pre-aging the aluminum alloy at a temperature in a range of about room temperature to about 100° C.; and performing subsequent steps of aging after preaging to improve tensile strength of the at least one of the cylinder head and the engine block by non-isothermally aging the pre-aged aluminum alloy by two-step aging at an aging temperature above the pre-aging temperature and then at a second aging temperature higher than the aging temperature, wherein the pre-aging and the aging steps are each at least an hour; and wherein the temperature changes following pre-aging are either in steps, in a continuous manner, or a combination thereof.

19. The method of claim 18 wherein the pre-aging temperature is at about 95° C. for about 2.5 hours followed by the two-step aging at about 180° C. for about 4 hours and about 200° C. for about 1 hour.

20. The method of claim 18 wherein the aging temperature is in the range of about 165° C. to about 200° C.

* * * * *